US010221546B2

(12) United States Patent
Mercieca

(10) Patent No.: US 10,221,546 B2
(45) Date of Patent: Mar. 5, 2019

(54) SOAP-DISPENSING SHOWER WAND ASSEMBLY

(71) Applicant: Martin Mercieca, Mississauga (CA)

(72) Inventor: Martin Mercieca, Mississauga (CA)

( * ) Notice: Subject to any disclaimer, the term of this patent is extended or adjusted under 35 U.S.C. 154(b) by 0 days.

(21) Appl. No.: 15/634,784

(22) Filed: Jun. 27, 2017

(65) Prior Publication Data

US 2018/0371727 A1 Dec. 27, 2018

(51) Int. Cl.

| | |
|---|---|
| ***A47K 7/02*** | (2006.01) |
| ***E03C 1/046*** | (2006.01) |
| ***B05B 7/32*** | (2006.01) |
| ***B05B 1/18*** | (2006.01) |
| ***E03C 1/04*** | (2006.01) |

(52) U.S. Cl.
CPC ..... *E03C 1/046* (2013.01); *B05B 1/185* (2013.01); *B05B 7/32* (2013.01); *E03C 1/0409* (2013.01)

(58) Field of Classification Search
CPC ..... A47K 7/024
USPC ..... 4/605–606
See application file for complete search history.

(56) References Cited

U.S. PATENT DOCUMENTS

| | | | |
|---|---|---|---|
| 4,282,623 | A | 8/1981 | Gacuzana |
| 6,151,728 | A | 11/2000 | Wright et al. |
| D484,314 | S | 12/2003 | DiGioia |
| 6,687,924 | B2 | 2/2004 | Wright et al. |
| 8,360,668 | B1 | 1/2013 | Hinnant |
| 2005/0103890 | A1 | 5/2005 | Doyle et al. |
| 2009/0224071 | A1 | 9/2009 | Yogashwer |
| 2014/0196227 | A1 | 7/2014 | Cooper |

FOREIGN PATENT DOCUMENTS

| | | |
|---|---|---|
| WO | WO2013156921 | 10/2013 |

*Primary Examiner* — Lori Baker

(57) ABSTRACT

A soap-dispensing shower wand assembly for lathering and scrubbing body parts includes a tube. A spray head is fluidically coupled to and extends substantially perpendicularly from a first end of the tube. A soap dispenser is coupled to and positioned in the tube. The soap dispenser is fluidically connected to the spray head. The soap dispenser is configured to position liquid soap and to selectively add the liquid soap to water that enters the spray head from the tube. A plurality of attachments is selectively fluidically couplable to the spray head. The tube is configured to be grasped in a hand of a user to position the spray head to lather and rinse hard-to-reach areas of a body of the user. A respective attachment that is positioned on the spray head is configured to scrub the body of the user.

19 Claims, 5 Drawing Sheets

SOAP-DISPENSING SHOWER WAND ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to shower wand assemblies and more particularly pertains to a new shower wand assembly for lathering and scrubbing body parts.

BRIEF SUMMARY OF THE INVENTION

An embodiment of the disclosure meets the needs presented above by generally comprising a tube. A spray head is fluidically coupled to and extends substantially perpendicularly from a first end of the tube. A soap dispenser is coupled to and positioned in the tube. The soap dispenser is fluidically connected to the spray head. The soap dispenser is configured to position liquid soap and to selectively add the liquid soap to water that enters the spray head from the tube. A plurality of attachments is selectively fluidically couplable to the spray head. The tube is configured to be grasped in a hand of a user to position the spray head to lather and rinse hard-to-reach areas of a body of the user. A respective attachment that is positioned on the spray head is configured to scrub the body of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
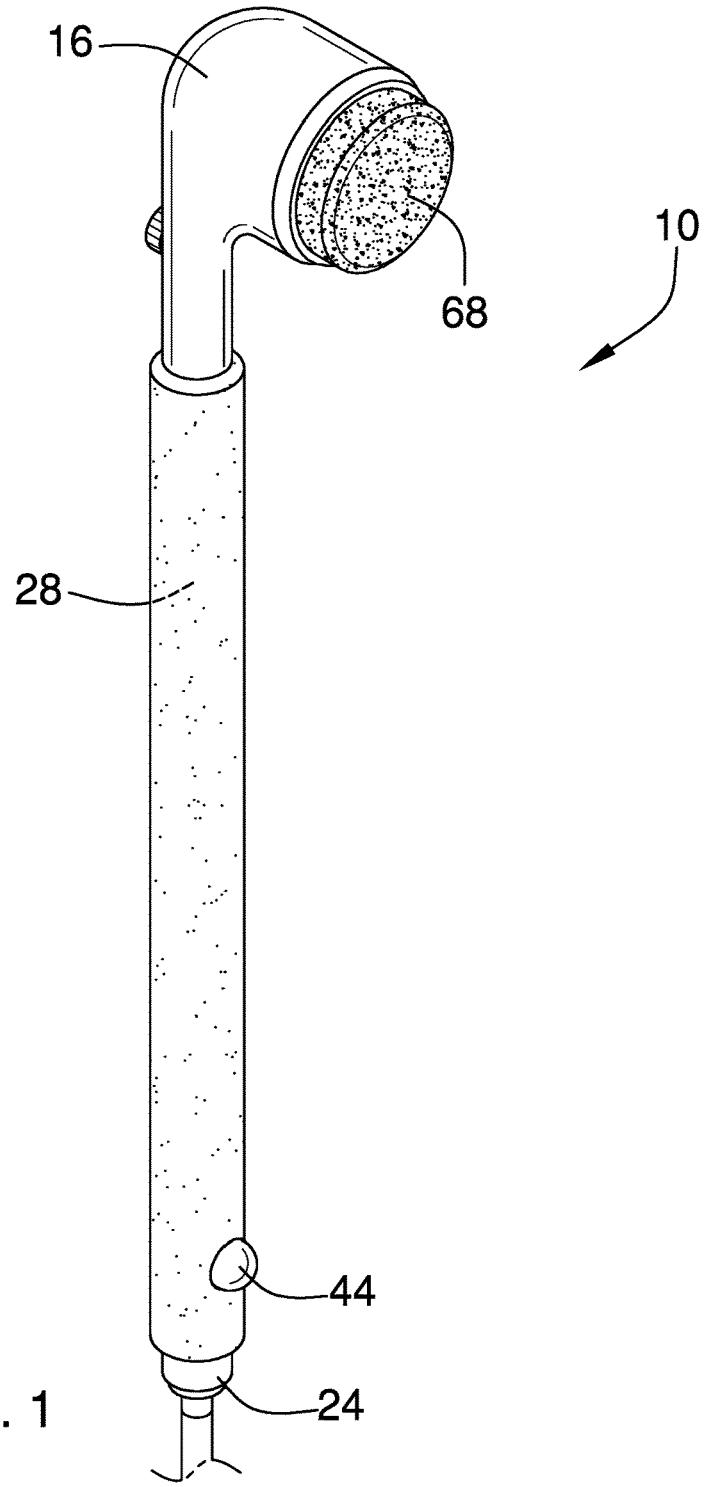
FIG. 1 is an isometric perspective view of a soap-dispensing shower wand assembly according to an embodiment of the disclosure.
Figure 2:
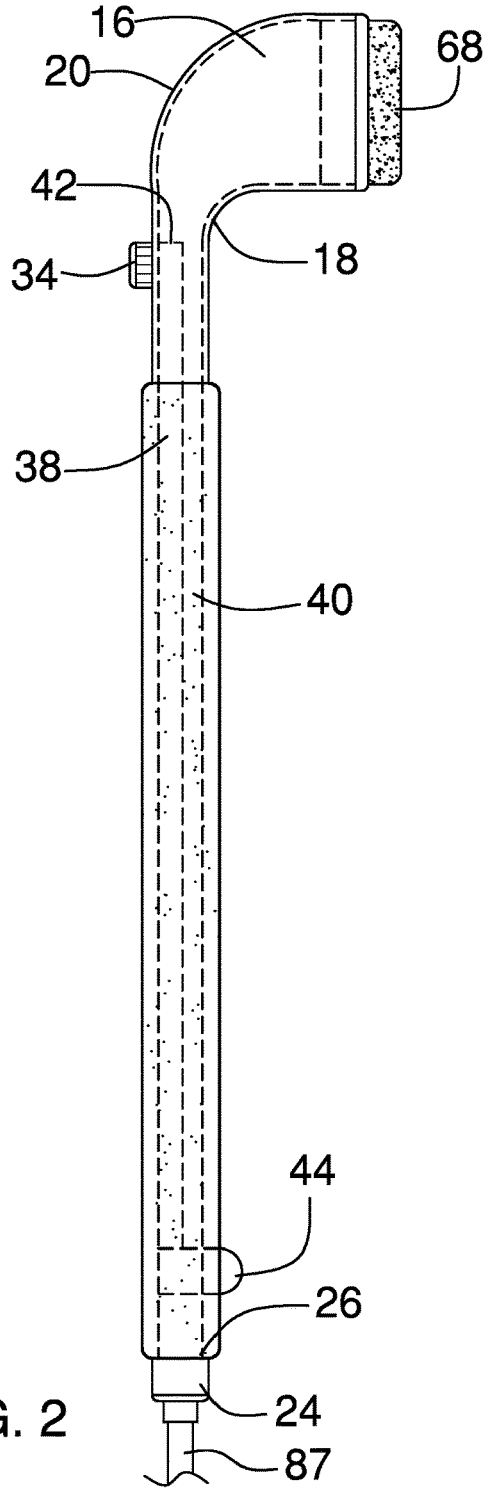
FIG. 2 is a side view of an embodiment of the disclosure.
Figure 3:
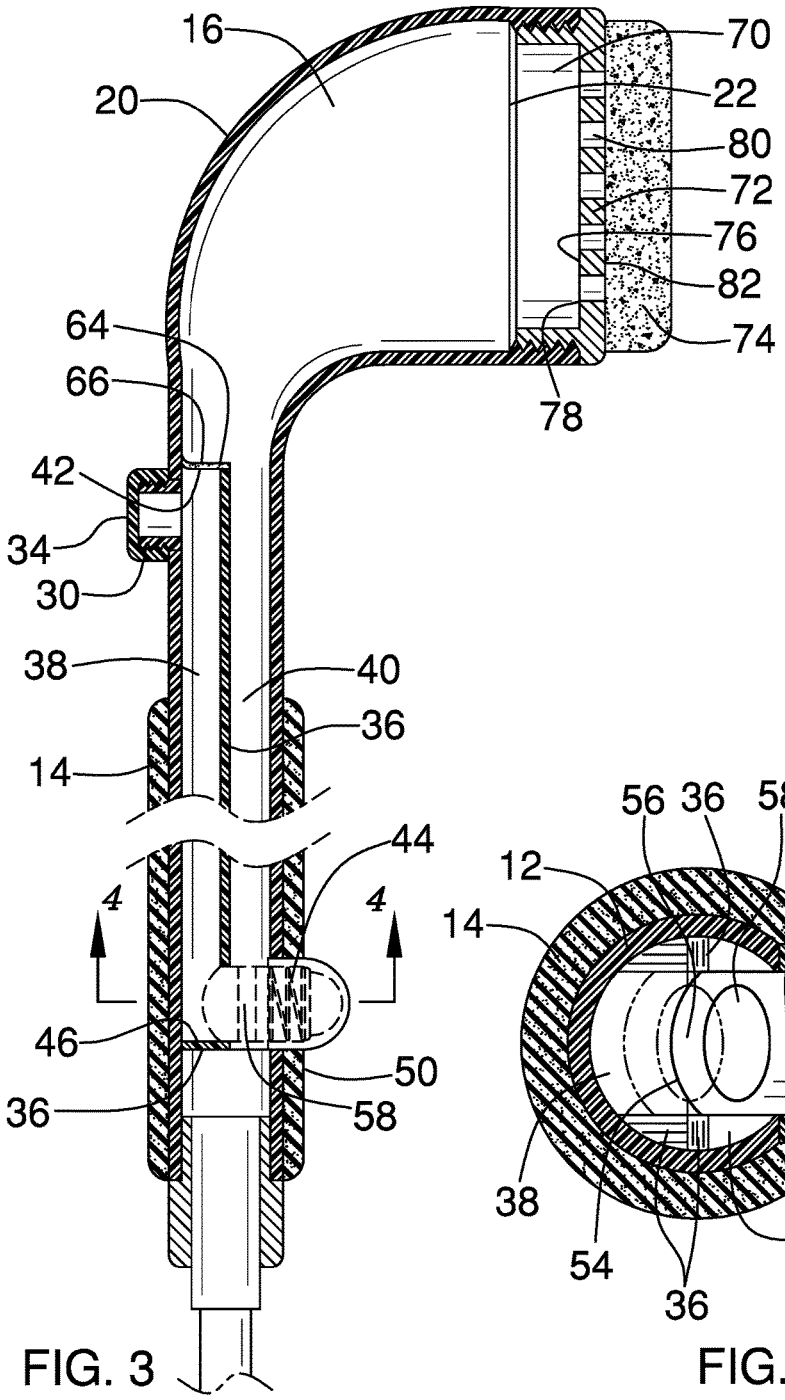
FIG. 3 is a cross-sectional view of an embodiment of the disclosure.
Figure 4:
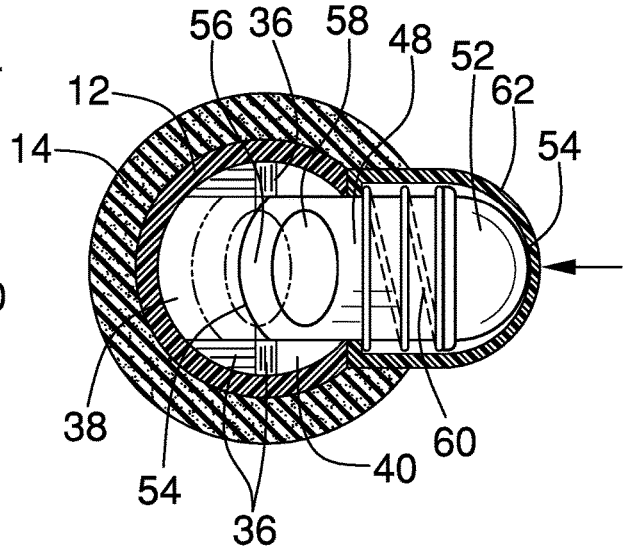
FIG. 4 is a cross-sectional view of an embodiment of the disclosure.
Figure 5:
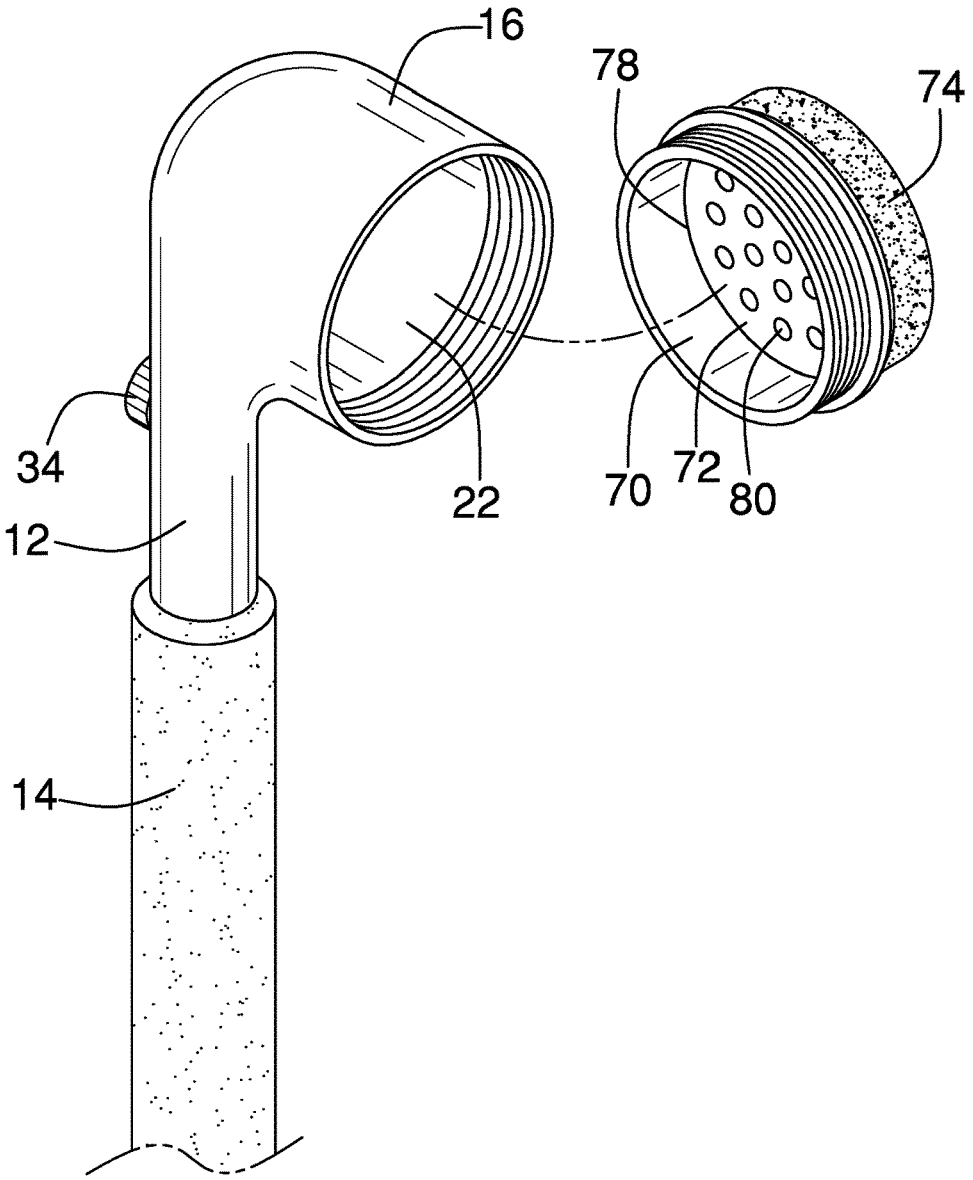
FIG. 5 is an isometric perspective view of an embodiment of the disclosure.
Figure 6:
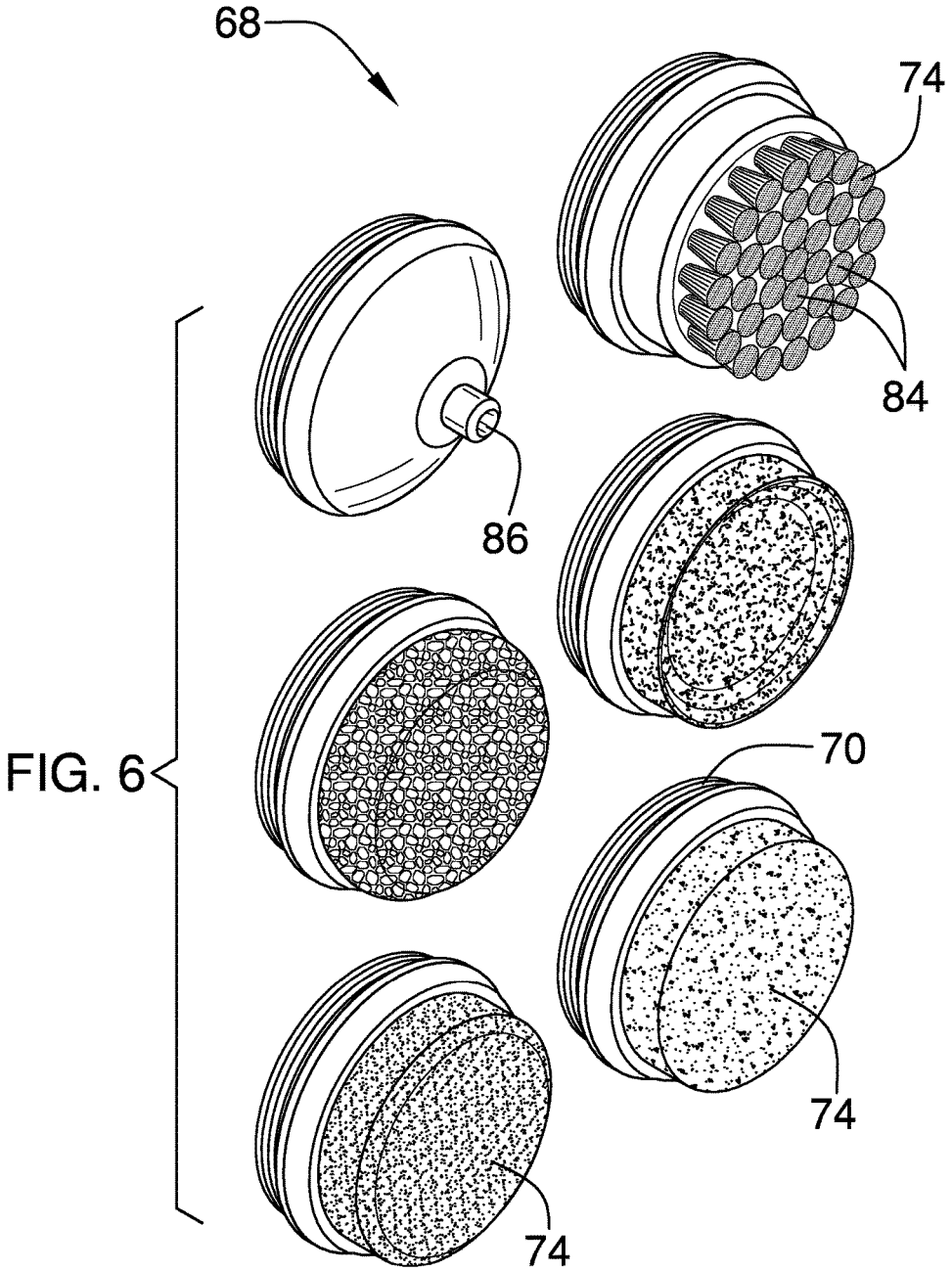
FIG. 6 is an isometric perspective view of an embodiment of the disclosure.

With reference now to the drawings, and in particular to FIGS. 1 through 6 thereof, a new shower wand assembly embodying the principles and concepts of an embodiment of the disclosure and generally designated by the reference numeral 10 will be described.

As best illustrated in FIGS. 1 through 6, the soap-dispensing shower wand assembly 10 generally comprises a tube 12. In one embodiment, the tube 12 is substantially circularly shaped when viewed longitudinally. A grip 14 is coupled to the tube 12. The grip 14 is configured to be grasped in a hand of a user. In one embodiment, the grip 14 comprises foam.

A spray head 16 is fluidically coupled to and extends substantially perpendicularly from a first end 18 of the tube 12. The spray head 16 has a back 20 that is positioned proximate to the tube 12. The back 20 is closed. In one embodiment, the back 20 is rounded. In another embodiment, the spray head 16 is substantially circularly shaped when viewed from the front 22. The spray head 16 has a front 22 that is open.

A connector 24 is coupled to a second end 26 of the tube 12. The connector 24 is configured to couple to a water supply hose 87.

A soap dispenser 28 is coupled to and positioned in the tube 12. The soap dispenser 28 is fluidically connected to the spray head 16. The soap dispenser 28 is configured to position liquid soap and to selectively add the liquid soap to water that enters the spray head 16 from the tube 12.

A pipe 30 is coupled to and extends from a back face 32 of the tube 12. The pipe 30 is fluidically coupled to the soap dispenser 28. The pipe 30 is configured to add the liquid soap to the soap dispenser 28. A first cap 34, which is complementary to the pipe 30, is configured to reversibly couple to the pipe 30 to close the pipe 30. In one embodiment, the pipe 30 is externally threaded and the first cap 34 is internally threaded.

A wall 36 is coupled to and positioned in the tube 12. The wall 36 extends longitudinally from proximate to the first end 18 to proximate to the second end 26. The wall 36 extends perpendicularly to the back face 32 of the tube 12 proximate to the second end 26 of the tube 12. The wall 36 defines a chamber 38 and a first channel 40 within the tube 12. The chamber 38 has an upper end 42 that is open. The chamber 38 is configured to position the liquid soap. The first channel 40 is configured to allow flow of the water from the water supply hose through the first channel 40 to the spray head 16.

A selector 44 is coupled to the tube 12 proximate to a lower end 46 of the chamber 38. The selector 44 is configured to selectively direct the water into the chamber 38 and the first channel 40. The selector 44 is positioned to selectively direct the water into the chamber 38 so that the liquid soap that is positioned in the chamber 38 is motivated through the upper end 42 into the spray head 16.

In one embodiment, the selector 44 comprises a first penetration 48 that is positioned through a front face 50 of the tube 12 proximate to the lower end 46 of the chamber 38. A cylinder 52, which is complementary to the first penetration 48, is positioned through the first penetration 48. The cylinder 52 has opposing ends 54. In another embodiment, the opposing ends 54 are rounded. A second penetration 56 is positioned through the wall 36 proximate to the lower end 46 of the chamber 38. The second penetration 56 is positioned to reversibly insert a respective opposing end 54 of the cylinder 52. A second channel 58 is positioned through the cylinder 52. The second channel 58 is configured to direct the water into the chamber 38 when the respective opposing end 54 of the cylinder 52 is positioned through the second penetration 56.

A spring 60 is coupled to and extends between the tube 12 and the cylinder 52. The cylinder 52 is configured to contact a digit of the hand of the user to press the cylinder 52 into the tube 12. The spring 60 is tensioned and the second channel 58 is configured to direct the water into the chamber 38. The spring 60 is configured to rebound when the digit of the hand is removed from the cylinder 52. The second channel 58 is withdrawn from the chamber 38 into the first channel 40.

A second cap 62 is coupled to the tube 12. The second cap 62 is positioned to cover a respective opposing end 54 of the cylinder 52 that protrudes from the tube 12. The second cap 62 is resilient.

A regulator 64 is coupled to the tube 12 proximate to the upper end 42 of the chamber 38. The regulator 64 is configured to selectively close the upper end 42 of the chamber 38. The regulator 64 is configured to close the upper end 42 of the chamber 38 to prevent the water from entering the chamber 38 through the upper end 42.

In one embodiment, the regulator 64 comprises a flap 66. The flap 66 is resilient. The flap 66 is configured to be opened when the water is directed into the lower end 46 of the chamber 38. The liquid soap that is positioned in the chamber 38 is motivated through the upper end 42 into the spray head 16. The flap 66 is configured to rebound to close the upper end 42 of the chamber 38 to prevent the water from entering the chamber 38 through the upper end 42. In another embodiment, the flap 66 comprises rubber.

A plurality of attachments 68 is selectively fluidically couplable to the spray head 16. The tube 12 is configured to be grasped in a hand of a user to position the spray head 16 to lather and rinse hard-to-reach areas of a body of the user. A respective attachment 68 that is positioned on the spray head 16 is configured to scrub the body of the user.

Each attachment 68 comprises a ring 70, a plate 72 and a tool 74. The ring 70 is complementary to the front 22 of the spray head 16 and externally threaded. The plate 72 has a first face 76 that is coupled to a terminus 78 of the ring 70. At least one hole 80 is positioned through the plate 72. The at least one hole 80 is configured to allow the water and the liquid soap to flow through the plate 72. The tool 74 is coupled to and extends from a second face 82 of the plate 72. The tool 74 is water permeable. The tool 74 is configured to direct the water onto the body of the user and to scrub the body of the user. In one embodiment, the tool 74 comprises sponge. In another embodiment, the tool 74 comprises pumice. In yet another embodiment, the tool 74 comprises loofah. In still yet another embodiment, the tool 74 comprises a plurality of bristles 84. In still yet another embodiment, the tool 74 comprises a nozzle 86.

In use, the connector 24 that is positioned on the tube 12 is configured to couple the tube 12 to the water supply hose. The pipe 30 that is positioned on the tube 12 is configured to add the liquid soap to the soap dispenser 28. The first cap 34 is configured to reversibly couple to the pipe 30 to close the pipe 30. The cylinder 52 is configured to contact the digit of the hand of the user to press the cylinder 52 into the tube 12. The spring 60 is tensioned and the second channel 58 is configured to direct the water into the chamber 38. The spring 60 is configured to rebound when the digit of the hand is removed from the cylinder 52 so that the second channel 58 is withdrawn from the chamber 38 into the first channel 40. The flap 66 that is positioned on the tube 12 is configured to be opened when the water is directed into the lower end 46 of the chamber 38. The liquid soap that is positioned in the chamber 38 is motivated through the upper end 42 into the spray head 16. The flap 66 is configured to rebound to close the upper end 42 of the chamber 38 to prevent the water from entering the chamber 38 through the upper end 42. The at least one hole 80 that is positioned through the plate 72 is configured to allow the water and the liquid soap to flow through the plate 72. The grip 14 that is positioned on the tube 12 configured to be grasped in the hand of the user to position the spray head 16 to lather and rinse the hard-to-reach areas of the body of the user. A respective tool 74 that is positioned on the plate 72 is configured to direct the water onto the body of the user and to scrub the body of the user.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A soap-dispensing shower wand assembly comprising:
a tube;
a spray head fluidically coupled to and extending substantially perpendicularly from a first end of said tube;
a soap dispenser coupled to and positioned in said tube, said soap dispenser being fluidically connected to said spray head, said soap dispenser being configured for positioning liquid soap and for selectively adding the liquid soap to water entering said spray head from said tube;
a plurality of attachments selectively fluidically couplable to said spray head; and
wherein said spray head is positioned on said tube such that said tube is configured for grasping in a hand of a user for positioning said spray head for lathering and rinsing hard-to-reach areas of a body of the user, and wherein a respective said attachment is positioned on said spray head such that said respective said attachment is configured for scrubbing the body of the user; and
each said attachment comprising
a ring complementary to a front of said spray head, said ring being externally threaded,
a plate having a first face coupled to a terminus of said ring,
at least one hole positioned through said plate,
a tool coupled to and extending from a second face of said plate, said tool being water permeable, and
wherein said at least one hole is positioned through said plate such that said at least one hole is configured for allowing the water and the liquid soap to flow through said plate, wherein said tool is positioned on said plate such that said tool is configured for directing the water onto the body of the user and for scrubbing the body of the user.

2. The assembly of claim 1, further comprising:
said tube being substantially circularly shaped when viewed longitudinally;
said spray head having a back positioned proximate to said tube, said back being closed, said back being rounded;
said spray head having a front, said front being open; and
said spray head being substantially circularly shaped when viewed from said front.

3. The assembly of claim 1, further including a grip coupled to said tube, wherein said grip is positioned on said tube such that said grip is configured for grasping in a hand of a user.

4. The assembly of claim 1, further including said grip comprising foam.

5. The assembly of claim 1, further including a connector coupled to a second end of said tube, said connector being configured for coupling to a water supply hose, wherein said connector is positioned on said tube such that said connector is configured for coupling said tube to the water supply hose.

6. The assembly of claim 1, further comprising:
a pipe coupled to and extending from a back face of said tube, said pipe being fluidically coupled to said soap dispenser;
a first cap complementary to said pipe, said first cap being configured for reversibly coupling to said pipe for closing said pipe; and
wherein said pipe is positioned on said tube such that said pipe is configured for adding the liquid soap to said soap dispenser.

7. The assembly of claim 6, further including said pipe being externally threaded, said first cap being internally threaded.

8. The assembly of claim 1, further comprising:
a wall coupled to and positioned in said tube, said wall extending longitudinally from proximate to said first end to proximate to said second end, said wall extending perpendicularly to a back face of said tube proximate to said second end of said tube defining a chamber and a first channel within said tube, said chamber having an upper end, said upper end being open;
a selector coupled to said tube proximate to a lower end of said chamber, said selector being configured for selectively directing the water into said chamber and said first channel; and
wherein said wall is positioned in said tube such that said first channel is configured for flowing of the water from the water supply hose through said first channel to said spray head, and wherein said chamber is configured for positioning the liquid soap, wherein said selector is positioned on said tube such that said selector is positioned for selectively directing the water into said chamber such that the liquid soap positioned in said chamber is motivated through said upper end into said spray head.

9. A soap-dispensing shower wand assembly comprising:
a tube;
a spray head fluidically coupled to and extending substantially perpendicularly from a first end of said tube;
a soap dispenser coupled to and positioned in said tube, said soap dispenser being fluidically connected to said spray head, said soap dispenser being configured for positioning liquid soap and for selectively adding the liquid soap to water entering said spray head from said tube;
a plurality of attachments selectively fluidically couplable to said spray head;
wherein said spray head is positioned on said tube such that said tube is configured for grasping in a hand of a user for positioning said spray head for lathering and rinsing hard-to-reach areas of a body of the user, and wherein a respective said attachment is positioned on said spray head such that said respective said attachment is configured for scrubbing the body of the user;
a wall coupled to and positioned in said tube, said wall extending longitudinally from proximate to said first end to proximate to said second end, said wall extending perpendicularly to a back face of said tube proximate to said second end of said tube defining a chamber and a first channel within said tube, said chamber having an upper end, said upper end being open;
a selector coupled to said tube proximate to a lower end of said chamber, said selector being configured for selectively directing the water into said chamber and said first channel;
wherein said wall is positioned in said tube such that said first channel is configured for flowing of the water from the water supply hose through said first channel to said spray head, and wherein said chamber is configured for positioning the liquid soap, wherein said selector is positioned on said tube such that said selector is positioned for selectively directing the water into said chamber such that the liquid soap positioned in said chamber is motivated through said upper end into said spray head; and said selector comprising a first penetration positioned through a front face of said tube proximate to said lower end of said chamber, a cylinder complementary to and positioned through said first penetration, said cylinder having opposing ends, said opposing ends being rounded, a second penetration positioned through said wall proximate to said lower end of said chamber, wherein said second penetration is positioned in said wall such that said second penetration is positioned for reversibly inserting a respective said opposing end of said cylinder, a second channel positioned through said cylinder, wherein said second channel is positioned through said cylinder such that said second channel is configured for directing the water into said chamber when said respective said opposing end of said cylinder is positioned through said second penetration, a spring coupled to and extending between said tube and said cylinder, and wherein said spring is positioned on said tube such that said cylinder is configured for contacting a digit of the hand of the user for pressing said cylinder into said tube such that said spring is tensioned, wherein said second channel is configured for directing the water into said chamber, and wherein said spring is configured for rebounding when the digit of the hand is removed from said cylinder such that said second channel is withdrawn from said chamber into said first channel.

10. The assembly of claim 9, further including a second cap coupled to said tube such that said second cap is positioned for covering a respective opposing end of said cylinder protruding from said tube, said second cap being resilient.

11. A soap-dispensing shower wand assembly comprising:

a tube;

a spray head fluidically coupled to and extending substantially perpendicularly from a first end of said tube;

a soap dispenser coupled to and positioned in said tube, said soap dispenser being fluidically connected to said spray head, said soap dispenser being configured for positioning liquid soap and for selectively adding the liquid soap to water entering said spray head from said tube;

a plurality of attachments selectively fluidically couplable to said spray head;

wherein said spray head is positioned on said tube such that said tube is configured for grasping in a hand of a user for positioning said spray head for lathering and rinsing hard-to-reach areas of a body of the user, and wherein a respective said attachment is positioned on said spray head such that said respective said attachment is configured for scrubbing the body of the user;

a wall coupled to and positioned in said tube, said wall extending longitudinally from proximate to said first end to proximate to said second end, said wall extending perpendicularly to a back face of said tube proximate to said second end of said tube defining a chamber and a first channel within said tube, said chamber having an upper end, said upper end being open;

a selector coupled to said tube proximate to a lower end of said chamber, said selector being configured for selectively directing the water into said chamber and said first channel;

wherein said wall is positioned in said tube such that said first channel is configured for flowing of the water from the water supply hose through said first channel to said spray head, and wherein said chamber is configured for positioning the liquid soap, wherein said selector is positioned on said tube such that said selector is positioned for selectively directing the water into said chamber such that the liquid soap positioned in said chamber is motivated through said upper end into said spray head; and a regulator coupled to said tube proximate to said upper end of said chamber, said regulator being configured for selectively closing said upper end of said chamber, wherein said regulator is positioned on said tube such that said regulator is configured for closing said upper end of said chamber for preventing water from entering said chamber through said upper end.

12. The assembly of claim 11, further including said regulator comprising a flap, said flap being resilient, wherein said flap is positioned on said tube such that said flap is configured for opening when the water is directed into said lower end of said chamber such that the liquid soap positioned in said chamber is motivated through said upper end into said spray head, and wherein said flap is configured for rebounding for closing said upper end of said chamber for preventing the water from entering said chamber through said upper end.

13. The assembly of claim 12, further including said flap comprising rubber.

14. The assembly of claim 1, further including said tool comprising sponge.

15. The assembly of claim 1, further including said tool comprising pumice.

16. The assembly of claim 1, further including said tool comprising loofah.

17. The assembly of claim 1, further including said tool comprising a plurality of bristles.

18. The assembly of claim 1, further including said tool comprising a nozzle.

19. The assembly of claim 1, further comprising:

said tube being substantially circularly shaped when viewed longitudinally;

a grip coupled to said tube, wherein said grip is positioned on said tube such that said grip is configured for grasping in a hand of a user, said grip comprising foam;

said spray head having a back positioned proximate to said tube, said back being closed, said back being rounded, said spray head having a front, said front being open, said spray head being substantially circularly shaped when viewed from said front;

a connector coupled to a second end of said tube, said connector being configured for coupling to a water supply hose, wherein said connector is positioned on said tube such that said connector is configured for coupling said tube to the water supply hose;

a pipe coupled to and extending from a back face of said tube, said pipe being fluidically coupled to said soap dispenser, wherein said pipe is positioned on said tube such that said pipe is configured for adding the liquid soap to said soap dispenser, said pipe being externally threaded;

a first cap complementary to said pipe, said first cap being configured for reversibly coupling to said pipe for closing said pipe, said first cap being internally threaded;

a wall coupled to and positioned in said tube, said wall extending longitudinally from proximate to said first end to proximate to said second end, said wall extending perpendicularly to said back face of said tube proximate to said second end of said tube defining a chamber and a first channel within said tube, said chamber having an upper end, said upper end being open, wherein said wall is positioned in said tube such that said first channel is configured for flowing of the water from the water supply hose through said first channel to said spray head, and wherein said chamber is configured for positioning the liquid soap;

a selector coupled to said tube proximate to a lower end of said chamber, said selector being configured for selectively directing the water into said chamber and said first channel, wherein said selector is positioned on said tube such that said selector is positioned for selectively directing the water into said chamber such that the liquid soap positioned in said chamber is motivated through said upper end into said spray head, said selector comprising:

a first penetration positioned through a front face of said tube proximate to said lower end of said chamber, a cylinder complementary to and positioned through said first penetration, said cylinder having opposing ends, said opposing ends being rounded, a second penetration positioned through said wall proximate to said lower end of said chamber, wherein said second penetration is positioned in said wall such that said second penetration is positioned for reversibly inserting a respective said opposing end of said cylinder, a second channel positioned through said cylinder, wherein said second channel is positioned through said cylinder such that said second channel is configured for directing the water into said chamber when said respective said opposing end of said cylinder is positioned through said second penetration, a spring coupled to and extending between said tube and said cylinder, wherein said spring is positioned on said tube such that said cylinder is configured for contacting a digit of the hand of the user for pressing said cylinder into said tube such that said spring is tensioned, wherein said second channel is configured for directing the water into said chamber, and wherein said spring is configured for rebounding when the digit of the hand is removed from said cylinder such that said second channel is withdrawn from said chamber into said first channel, and a second cap coupled to said tube such that said second cap is positioned for covering a respective opposing end of said cylinder protruding from said tube, said second cap being resilient;

a regulator coupled to said tube proximate to said upper end of said chamber, said regulator being configured for selectively closing said upper end of said chamber, wherein said regulator is positioned on said tube such that said regulator is configured for closing said upper end of said chamber for preventing water from entering said chamber through said upper end, said regulator comprising a flap, said flap being resilient, wherein said flap is positioned on said tube such that said flap is configured for opening when the water is directed into said lower end of said chamber such that the liquid soap positioned in said chamber is motivated through said upper end into said spray head, and wherein said flap is configured for rebounding for closing said upper end of said chamber for preventing the water from entering said chamber through said upper end, said flap comprising rubber;

each attachment comprising:

said tool comprising sponge, said tool comprising pumice, said tool comprising loofah, said tool comprising a plurality of bristles, said tool comprising a nozzle; and wherein said connector is positioned on said tube such that said connector is configured for coupling said tube to the water supply hose, wherein said pipe is positioned on said tube such that said pipe is configured for adding the liquid soap to said soap dispenser, wherein said first cap is configured for reversibly coupling to said pipe for closing said pipe, wherein said spring is positioned on said tube such that said cylinder is configured for contacting the digit of the hand of the user for pressing said cylinder into said tube such that said spring is tensioned, wherein said second channel is configured for directing the water into said chamber, and wherein said spring is configured for rebounding when the digit of the hand is removed from said cylinder such that said second channel is withdrawn from said chamber into said first channel, wherein said flap is positioned on said tube such that said flap is configured for opening when the water is directed into said lower end of said chamber such that the liquid soap positioned in said chamber is motivated through said upper end into said spray head, and wherein said flap is configured for rebounding for closing said upper end of said chamber for preventing the water from entering said chamber through said upper end, wherein said at least one hole is positioned through said plate such that said at least one hole is configured for allowing the water and the liquid soap to flow through said plate, wherein said grip is positioned on said tube such that said grip is configured for grasping in the hand of the user for positioning said spray head for lathering and rinsing the hard-to-reach areas of the body of the user, and wherein a respective said tool is positioned on said plate such that said respective said tool is configured for directing the water onto the body of the user and for scrubbing the body of the user.

* * * * *